United States Patent [19]

Arnould

[11] 3,981,339

[45] Sept. 21, 1976

[54] SECRET COMPARTMENT ARTICLE

[76] Inventor: Marcel M. Arnould, 17 E. Midland Ave., Kearny, N.J. 07032

[22] Filed: May 29, 1975

[21] Appl. No.: 581,828

[52] U.S. Cl. ..... 150/36; 150/37

[51] Int. Cl.[2] ..... A45C 1/00

[58] Field of Search ..... 150/36, 37

[56] References Cited

UNITED STATES PATENTS

| | | | |
|---|---|---|---|
| 506,843 | 10/1893 | Chesak | 150/36 |
| 979,303 | 12/1910 | Horsfall | 150/36 |
| 1,807,826 | 6/1931 | Brady | 150/36 |

*Primary Examiner*—Donald F. Norton

[57] ABSTRACT

In a preferred embodiment, an elongated material has slits extending from a central portion in parallel arrangement along the elongated direction and an upper material is stitched to a lower material through the elongated material for a greater part of the common widths of the elongated material and the upper and lower materials, but also stitched between the upper and lower materials for the remainder of the common widths but only through the slits for thereby making possible withdrawal of material only adjacent and between stitches of the remainder of the common widths such that a closed compartment space formed between the intermediate elongated material and the third or lower material is accessible through slots of the slits where material has been withdrawn only in an area of the remainder of the common width where the stitches do not engage the elongated material.

1 Claim, 6 Drawing Figures

FIG. 1
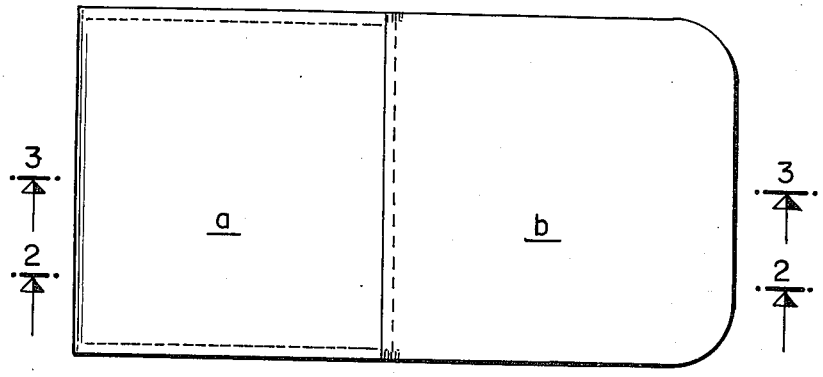
FIG. 2
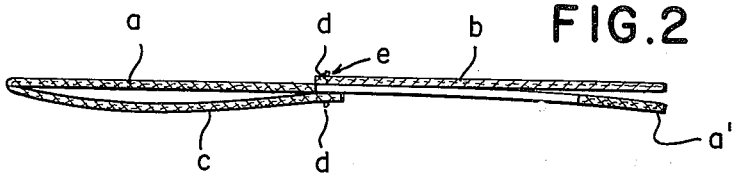
FIG. 3
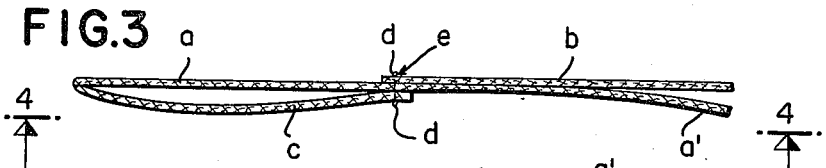
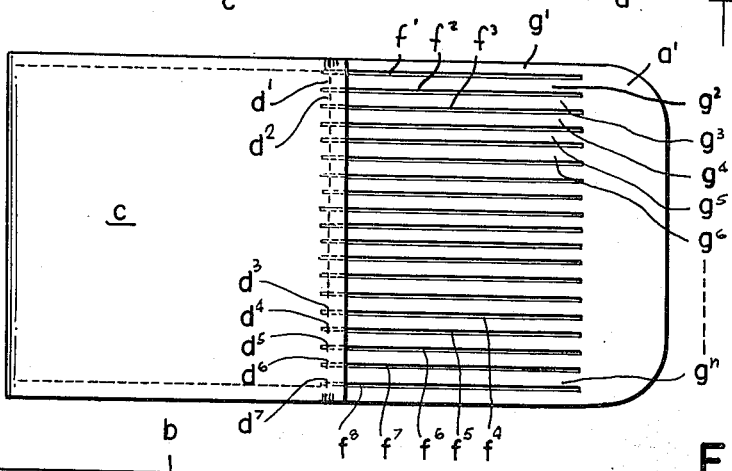
FIG. 4
FIG. 5
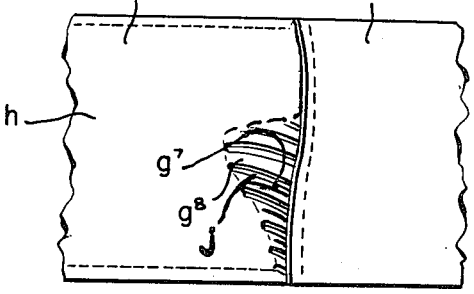
FIG. 6
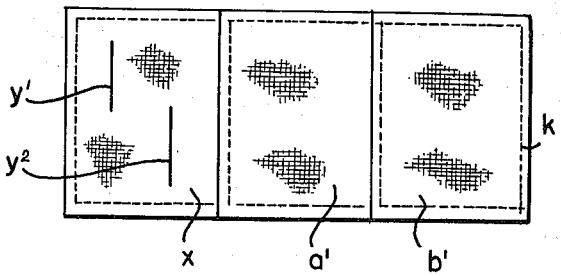

SECRET COMPARTMENT ARTICLE

This invention relates to a secret compartment as in a coin wallet or the like.

BACKGROUND TO THE INVENTION

Heretofore there has existed a secret compartment wallet or coin holder of a design substantially resembling that of the present invention, except that the secret of finding the entry mechanism for gaining access thereinto was substantially more simple than for the present invention, the prior article having stitches sewing the first and third layers "consistently" always through the slits across the entire width of the elongated central material such that accidental exploratory pulling of various materials could often result in the material being pulled past the stitches sufficient to detect the secret of the central material not being sewn, the stitches extending solely through the slits.

SUMMARY OF THE INVENTION

Objects of the invention include the overcoming of one or more difficulties of the type discussed above, together with new and novel advantages and features.

Another object is to provide a secret wallet having an access opening of a size receivable solely of a limited predetermined sized coin or other article.

Another object is to provide a secret wallet having an access opening structure structured such that a flat coin of predetermined maximum size limitation is receivable solely when positioned in a plane parallel with a slit of unstitched material.

Other objects become apparent from the preceding and following disclosure.

One or more objects of the present invention are obtained by the invention as defined herein.

Broadly the invention may be defined as a secret wallet having a concealed access opening to a compartment of the wallet, the major improvement being that for a strip material sandwiched between two other upper and lower materials, stitches extending between the upper and lower materials also extend through fabric material of the intermediate elongated strip material having slits, for a substantial part of the common widths, with only a minor remaining portion of the common widths having the stitches between the upper and lower materials extending not through the intermediate material but through the slits of the intermediate material, such that the intermediate material cannot be moved except in the very limited area of the portion where the stitches extend through the slits. Thus, in contrast to prior secret wallet compartment structures of this general type where at "any" point along the apparently stitched width all stitches went through slits permitting easy withdrawal of intermediate material anywhere along the width, the present inventive structure resists withdrawal by random pulling and tugging, except by deliberate pulling at the point of minor remaining width only there the stitches being through the slits of the intermediate material. Also, in a preferred embodiment the minor remaining width is limited to a width for example less than the diameter of a quarter, where only in that remaining width do the stitches extend through slits, such that solely by pulling-through the slitted strips substantially and significantly, only then is the quarter-sized coin able to be slipped into the secret compartment when the coin is positioned in a substantially common plane with the slit(s). It is of course possible to utilize any coin or symbolic coin and to reduce the unstitched remaining width in size accordingly, as might be desired, as for a dime for example which is of lesser diameter than a quarter or than a nickel.

Also, within the contemplated scope of the invention, the length(s) of the upper and lower strip(s) may be varied in their respective length and in the presence of limited slits therein in one or more directions, merely to add to the general confusion and distractions from the truly concealed access mechanism.

The invention may be better understood by making reference to the following Figures.

THE FIGURES

FIG. 1 illustrated an elevation plan view of an upper surface of a typical and preferred embodiment of the present invention.

FIG. 2 illustrates a view in side cross-section as taken along lines 2—2 of FIG. 1.

FIG. 3 illustrates a view in side cross-section as taken along lines 3—3 of FIG. 1.

FIG. 4 illustrates an elevation plan view of the bottom of the embodiment as taken along lines 4—4 of FIG. 3.

FIG. 5 illustrates in in-part view the embodiment and view of FIG. 4 except illustrating withdrawn material at the points where the stitches pass through the slits of the intermediate material, thus providing the access opening herein illustrated.

FIG. 6 in elevation plan view illustrates an alternate wallet.

DETAILED DESCRIPTION

FIGS. 1 through 5 illustrate a common embodiment, while FIG. 6 embodiment differs only in a further extension in length of the lower sheet *c* and of the intermediate sheet *a* and the actual stitching together thereof to form a further compartment with slits $y^1$ and $y^2$ in the *a*-extension designated portion *x*, and with also possibly actual stitching *k* unifying sheets *b* and the stripped portion of the elongated intermediate strip, designated (in FIGS. 2 and 3) as fabric *a'*.

Accordingly, in the FIGS. 1 through 5 embodiment, there is an upper strip *b* and a lower strip *c* having the intermediate strip *a* stitched through strip *a* by stitches *e* having upper and lower stitch portions *d*, at points between (not through) stitches, as slits *f* $d^1$, $d^2$, and the like going "though" material (between slits) such as strip material, $g^2$, $g^3$, and the like; whereas stitches $d^3$ through $d^7$ extend through the slits $f^4$ through $f^8$ respectively, thus permitting withdrawal of strips such as strip $g^7$ $g^8$ as illustrated in FIG. 5 where pulled portion *h* (of material *a*) has pulled the strips through thereby providing an access opening *j*.

The parts described above, such as the three layers of stacked strips of materials and stitching thread, may be in an unassembled state ready for assembling, with the three strip materials including markings indicia, together with instructional material.

It is within the scope of the present invention to make such other variations and modifications as might be desired including substitution of equivalents, and the like, as within the skill of an ordinary artisan.

I claim:

1. A secret compartment device comprising in combination: at least three strip materials including a first upper material and a second intermediate material at least in part located below the first upper material in a stacked relationship, and a third lower material at least in part located below the second intermediate material in a stacked relationship, said second intermediate material having a plurality of slits extending in substantially parallel relationship to one-another from substantially a central point between opposite ends of an elongated axis of the second intermediate material, each of the three strip materials having a substantially common width with one-another, one portion of the first material being stitched to one portion of the material of the second intermediate material located between said slits, and to and through material of the third lower material for a first predetermined portion of said common width comprising a major proportion of said width, a second portion of the first upper material adjacent said one portion and comprising the remainder of said common width having second stitches stitched through said slits with the second stitches being stitched to a remaining second predetermined portion of the third lower material adjacent said one portion of said lower material, and there being an end portion located and spaced a predetermined distance from said stitches secondly stitched, the end portion including at least one of said first upper material and said third lower material being unified with said second intermediate material along edges thereof extending to and from said stitches such that an enclosure space is defined and such that for said remainder of the common width at said second predetermined portion said second stitches are slidable between the slits whereby said second intermediate material is slidable in a direction toward the enclosure space whereby articles may be inserted through slits of material pulled sufficiently in said direction, into the enclosure space and thereafter may be similarly removed therefrom.

* * * * *